US007401742B2

(12) United States Patent
Dancey et al.

(10) Patent No.: US 7,401,742 B2
(45) Date of Patent: Jul. 22, 2008

(54) FLUID CIRCULATION APPARATUS FOR TEMPORARY HEATING

(75) Inventors: Larry Dancey, Malfort (CA); Claude Joseph Bourgault, St. Brieux (CA)

(73) Assignee: DRYAIR, Inc., St. Brieux, Saskatchewan (CA)

( * ) Notice: Subject to any disclaimer, the term of this patent is extended or adjusted under 35 U.S.C. 154(b) by 493 days.

(21) Appl. No.: 11/061,647

(22) Filed: Feb. 22, 2005

(65) Prior Publication Data

US 2006/0196958 A1 Sep. 7, 2006

(51) Int. Cl.
*B60H 1/02* (2006.01)

(52) U.S. Cl. ..... 237/12.3 B; 237/73; 237/67; 122/20 R

(58) Field of Classification Search ..... 237/73, 237/12.3 B, 67, 70, 16; 122/DIG. 10, 20 R, 122/20 A See application file for complete search history.

(56) References Cited

U.S. PATENT DOCUMENTS 1,628,664 A * 5/1927 Grutter ..... 122/20 A
1,949,471 A * 3/1934 Hildebrand, Jr. et al. . 122/136 R
2,088,647 A * 8/1937 Gilroy ..... 165/145
2,410,900 A * 11/1946 Radbill ..... 122/504.1
2,572,317 A * 10/1951 Chausse ..... 122/4 R
2,677,353 A * 5/1954 Sharp ..... 122/12
2,699,155 A * 1/1955 Olson et al. ..... 122/274
4,798,240 A * 1/1989 Gerstmann et al. ..... 165/48.1
4,915,297 A * 4/1990 Norman et al. ..... 237/8 A
5,732,764 A * 3/1998 Douglas et al. ..... 165/41
5,823,175 A * 10/1998 Sweitzer et al. ..... 126/34
6,325,297 B1 * 12/2001 Calvin et al. ..... 237/12.3 B
6,739,517 B1 * 5/2004 Krueger ..... 237/19
6,925,968 B1 * 8/2005 Hwang et al. ..... 122/40
7,100,540 B2 * 9/2006 Vaughan ..... 122/40
2003/0056390 A1 3/2003 Adrian

* cited by examiner

*Primary Examiner*—Derek S Boles
(74) *Attorney, Agent, or Firm*—Nixon & Vanderhye P.C.

(57) ABSTRACT

A temporary heating apparatus comprises a portable heat exchanger which transfers heat from a hot fluid circulating in a primary circulation loop thereof to a heated liquid circulating in a secondary circulation loop thereof. The heat exchanger is connectable to a hot fluid source such that hot fluid from the hot fluid source circulates through the primary circulation loop. A portable remote heating unit comprises a fluid coil releasably connected by flexible conduits to the secondary circulation loop, and a secondary pump is connected to the flexible conduits and the secondary circulation loop to pump heated liquid through the secondary circulation loop, flexible conduits, and the fluid coil of the remote heating unit. The heat exchanger isolates the heating circuit from the hot fluid source, allowing the use of steam as the hot fluid source, and further allowing high pressures in the heating circuit, such as encountered in tall buildings.

15 Claims, 2 Drawing Sheets

FLUID CIRCULATION APPARATUS FOR TEMPORARY HEATING

This invention is in the field of heating systems and in particular such systems for temporarily heating for construction and renovation.

BACKGROUND

Construction and renovation in cold climates requires that temporary heat be provided so that workers can function effectively. Conventionally, such temporary heat has been provided by construction heaters that include a burner burning a fuel, typically propane, and a fan to circulate the air warmed by the burner in the area to be heated. Such direct combustion creates exhaust fumes in the area heated that can present health hazards to workers. As well, combustion creates moisture leading to increased relative humidity in the work area. Construction materials absorb the moisture and can be damaged, or later warp when the relative humidity returns to a normal level.

For this reason heat exchangers have been used whereby the exhaust and moisture created by combustion are kept separated from an air stream that is heated and directed into the construction area. Such a heat exchanger system is generally disclosed for example in United States Patent Application No. 2003/0056390 of Adrian. Circulating liquid construction heating systems are also known that include a liquid heater that heats liquid, typically a mixture of water and glycol, and a pump that circulates the heated liquid through conduits to portable remote heating units located in one or more construction areas. The remote heating units typically comprise a coil and a fan. The warmed liquid circulates through the coil and the fan blows air through the coil to be heated and circulated through the area where the unit is located. Moisture and exhaust fumes created by combustion at the liquid heater are thus kept remote from the areas being heated.

The liquid pressure generated by the circulating pump in a typical circulating liquid heating system is relatively low at about 30-40 psi, similar to the pressure in a water supply system. Typically as well, conventional circulating liquid heating systems are configured such that the intake of the pump is connected to the output of the liquid heater. The pump thus draws liquid through the heater instead of pushing it through the heater, and so the liquid in the heat exchange section of the heater is under negligible, if any, positive pressure. Liquid in the heat exchange section is typically directly connected to a permanently open atmospherically vented expansion tank, located at an elevation above the circulation pump, such that as the liquid temperature rises extra liquid volume can flow into the expansion tank, and if the temperature falls, or if there is a leak in the conduits, or extra liquid is required during set-up, extra liquid volume can flow from the expansion tank back into the conduits. Thus the conduits are kept full, and only atmospheric pressure is present in the heat exchange section of the liquid heater.

Such a configuration results in an inherently safe system. Such liquid heaters are not required to meet regulated safety specifications or be regularly inspected as is the case with boilers and pressure vessels. For regulation purposes, the liquid heater is classed essentially as a water heater, since the pressure in the heat exchange portion thereof is at zero pressure relative to the atmosphere, and further pressures developed by the circulating pump do not exceed that of a water supply system.

In many areas, high rise buildings of 30 to 70 stories or more have been in existence for many years, and renovation of such high rise buildings is becoming common, requiring temporary heating. Construction of such buildings also requires temporary heating to allow construction to proceed during cold weather.

Using conventional circulating liquid heating systems during construction and renovation of high rise buildings presents certain challenges compared to use in buildings that are relatively close to the ground. Most conveniently the liquid heater will be located at ground level for ease of fuel delivery. The ground level liquid heater location also facilitates the addition of liquid to the circulating liquid system as will be required when setting up the system, and when the conduits are lengthened, or more remote heating units are added to the system. In addition such liquid heaters can be quite cumbersome, and difficult to move to upper areas of a building. In order to operate such circulating liquid systems with the liquid heater on the ground, it is required to circulate the liquid under high pressure conditions caused by the high elevation of the remote heating units.

While considerable pressure is required to raise the heated liquid to the upper floors of a high rise building, once the conduits up to the remote heating units are full of liquid, the pressure on the downward flowing portion of the conduits will substantially balance the pressure on the upward flowing portion thereof, and the conventional circulating pump generating a pressure of about 35 psi, such as would be used in a conventional circulating liquid heating system, would provide sufficient pressure to circulate the liquid in the full system. The result however is that the pressure in the liquid at the bottom portion of the conduits will be that developed by the head of liquid in the conduits on the return side of the pump, and on the supply or output side of the pump the pressure will be that developed by the head of liquid in the conduits plus the pump pressure.

Every 2.3 feet of water in a vertical conduit generates about one pound per square inch (psi) of pressure. Thus where the remote heating units are 230 feet above a liquid heater at ground level, the pressure in the liquid at the bottom of the conduits will be about 100 psi. Similarly where the remote heating units are 690 feet above a liquid heater at ground level, for example on the $69^{th}$ story of a building, the pressure in the liquid at the bottom of the conduits will be about 300 psi. The conventional circulation pump generating a 35 psi pressure differential between the input and output would suffice to circulate the liquid through the conduits, and the pressure at the input of the pump would be 300 psi, and at the output about 335 psi.

Flexible conduits of the type used with conventional circulating liquid heating systems can readily be made to withstand pressures of 300 psi or more, and the operation of the remote heating units of such a system is not adversely affected by the elevation as long as sufficient liquid flows through their coils. The elevation does however adversely affect the liquid heater of conventional systems.

Thus while such a conventional circulating liquid heating system could theoretically be used in a high rise application, the expansion tank would need to be sealed from the atmosphere, or alternately raised above the highest level at which remote heating units will be located. Once the conduits to the remote heating units were filled, the liquid flowing through the liquid heater would be pressurized to a considerable pressure resulting from the high elevation of the remote heating units and conduits connecting them. Considerable expense would be involved in re-designing such heaters then to meet the safety specifications for pressure vessels.

Steam heating is popular for use in large buildings. In densely populated urban areas, such as where high rise buildings are typically located, heat is often provided by a steam generation utility that transports steam from a central location to buildings in an area that might encompass several city blocks. Steam heat is thus available simply by connecting the steam utility pipes to a suitable steam heating system in an existing or newly constructed building, much the same as connecting to water or electrical utilities. Where steam heat is available, the cost is generally favorable compared to other heating options.

Steam heating systems in buildings typically comprise steam supply pipes and condensate return pipes connected to a steam source such as a steam boiler or steam utility supply system. On each floor a distribution network of steam supply pipes, radiators, condensate return pipes, vents, and steam traps are properly sloped and configured so that steam will flow into the radiators, condense, and flow downhill back to the steam source as water. All these fixtures will be removed when, for example, the renovation involves gutting the building interior completely. Commonly during renovations, such a steam heat source might be available but the precision required to lay out a properly functioning temporary distribution system for the steam has made it impractical to use the steam heat for temporary heating during renovations. Similarly during new construction the steam heat source may be available, however it has not been practical to utilize it during construction.

SUMMARY OF THE INVENTION

It is an object of the present invention to provide a temporary heating system that overcomes problems in the prior art.

The present invention provides in one embodiment, a temporary heating apparatus comprising a portable heat exchanger operative to transfer heat from a hot fluid circulating in a primary circulation loop thereof to a heated liquid circulating in a secondary circulation loop thereof. The heat exchanger is adapted for connection to a hot fluid source such that hot fluid from the hot fluid source circulates through the primary circulation loop. At least one portable remote heating unit comprises a fluid coil releasably connected by flexible conduits to the secondary circulation loop, and a secondary pump is operatively connected to the flexible conduits and to the secondary circulation loop of the heat exchanger and is operative to pump heated liquid through the secondary circulation loop, flexible conduits, and the fluid coil of the at least one remote heating unit.

In a second embodiment the invention provides a temporary heating system comprising a portable heat exchanger operative to transfer heat from a hot fluid circulating in a primary circulation loop thereof to a heated liquid circulating in a secondary circulation loop thereof; a primary pump operative to circulate hot liquid from a liquid heater through the primary circulation loop; a plurality of portable remote heating units, each remote heating unit comprising a fluid coil releasably connected by flexible conduits to the secondary circulation loop; and a secondary pump operatively connected to the flexible conduits and to the secondary circulation loop of the heat exchanger and operative to pump heated liquid through the secondary circulation loop, flexible conduits, and the fluid coils of the remote heating units.

The heat exchanger isolates the hot fluid source from the heating circuit, comprising the secondary circulation loop of the heat exchanger, flexible conduits, and the fluid coils of the remote heating units. With the hot fluid source isolated, virtually any hot fluid source can be used that will circulate a hot fluid, either liquid or gaseous, through the primary circulation loop. Thus where steam is available, the heat exchanger can be configured and located for steam and condensate to flow properly through the primary circulation loop to heat the liquid in the secondary circulation loop.

Similarly, with the hot fluid source isolated from the heating circuit, pressure can be greatly increased in the heating circuit without affecting pressure in the primary circulation loop. Thus steam can be used to heat liquid in the heating circuit, and pressure in the heating circuit can be very high as the result of locating the remote heating units at upper floors of a high rise building. Similarly a conventional liquid heater, operating at low pressure and not subject to pressure vessel regulations, can be used to heat liquid in the heating circuit that is at high pressures.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
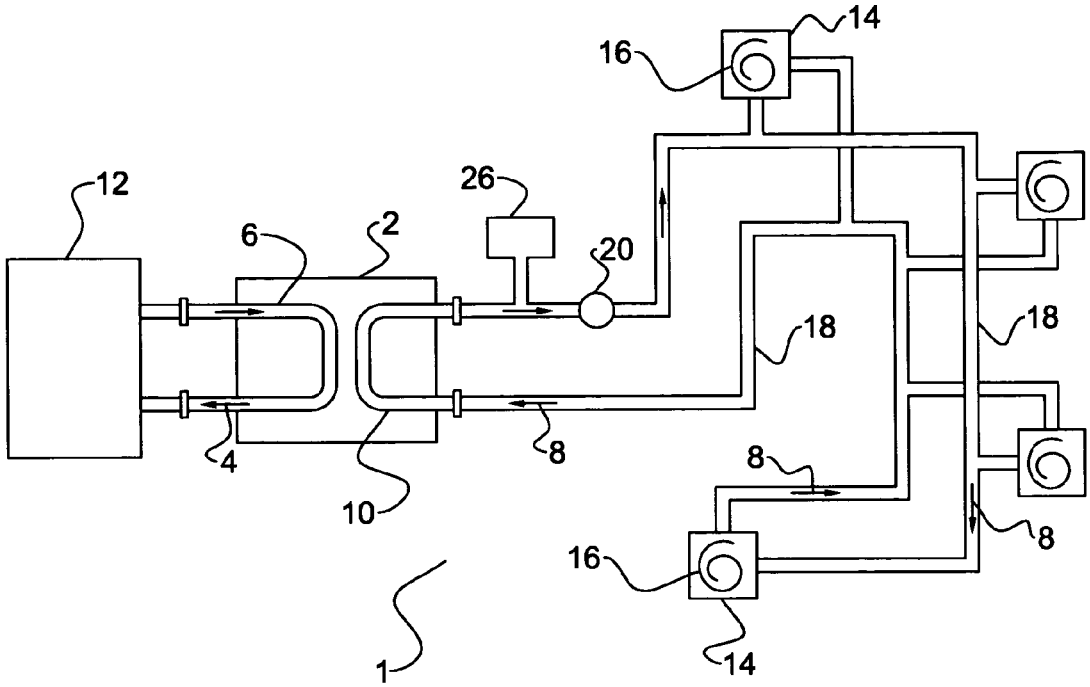
FIG. 1 is a schematic illustration of a temporary heating apparatus of the present invention where the hot fluid source can be a steam supply source or hot liquid supply source.

FIG. 1 schematically illustrates a temporary heating apparatus 1 of the present invention comprising a portable heat exchanger 2 operative to transfer heat from a hot fluid 4 circulating in a primary circulation loop 6 thereof to a heated liquid 8 circulating in a secondary circulation loop 10 thereof. While many types of heat exchangers 2 would be suitable for the present purpose, a plate heat exchanger is convenient, comprising a pack of thin, corrugated metal plates made from stainless steel or exotic metals with external ports and corresponding passages forming the primary and secondary circulation loops between which the desired heat transfer will occur.

The heat exchanger is adapted for connection to a hot fluid source 12 such that hot fluid 4 from the hot fluid source 12 circulates through the primary circulation loop 6. Portable remote heating units 14 each comprise a liquid coil 16 releasably connected by flexible conduits 18 to the secondary circulation loop 10. The remote heating units 14 also typically comprise a fan (not illustrated) to circulate air in the location through the liquid coil 16 to heat the air. A secondary pump 20 is operatively connected to the flexible conduits 18 and to the secondary circulation loop 10 of the heat exchanger 2 and is operative to pump heated liquid 8 through the secondary circulation loop 10, flexible conduits 18, and the liquid coils 16 of the remote heating units 14.

Thus the apparatus 1 is readily moved from one location to another. The remote heating units 14 can be placed in those areas where heat is required, and releasably connected by the required number and length of flexible conduits 18 as illustrated to the heat exchanger 2 and secondary pump 20 so that heated liquid 4 circulates through the secondary circulation loop 10, where it is heated, and through the fluid coils 16 where it in turn heats the air in the location. The number of remote heating units 14 required for each job will depend on the area to be heated and the temperature rise desired.

When setting up the apparatus 1 at a heating location the liquid to be heated, typically a glycol and water mixture, must be added to fill a heating circuit comprising the secondary circulation loop 10 of the heat exchanger 2, the flexible conduits 18, and the liquid coils 16 in the remote heating units 14. The flexible conduits 18 may be pre-charged with liquid however it is typically necessary to top up the liquid after connection of the elements of the heating circuit. Conventional air eliminators are located in the heating circuit to remove air.

Once these parts are connected together and the heating circuit is complete, a secondary liquid reservoir 26 is illustrated and operatively connected to an intake of the secondary pump 20. The secondary liquid reservoir is open to the atmosphere, and is located higher than any part of the heating circuit. The secondary pump 20 draws liquid from secondary liquid reservoir 26 and pumps it through the heating circuit until it is filled, and the liquid reservoir 26 is available to absorb expansion and retraction in the heated liquid 8.

In many construction or renovation locations a steam source, such as a steam generation utility or a steam boiler, will be available however the final heating system will not yet be installed. With conventional temporary heating systems, it has not been practical to utilize the steam heat source during construction because of the requirements that conduits connecting radiators and the steam source be properly oriented to allow the steam to condense and flow back to the source. During construction and renovation it is common to require heat in different locations from time to time during the course of the project. The present apparatus 1 provides a heat exchanger 2 that can be configured and located properly with respect to the steam source such that steam will circulate through the primary circulation loop 6. The heat exchanger 2 can be left in one location once properly set up, and the heat distributed by locating the remote heating units 14 as required and circulating heated fluid 8 through the heat exchanger 2 to pick up heat from the steam, and then through flexible conduits 18 to the remote heating units 14.

The hot fluid source 12 could also be provided by a liquid heater operative to circulate heated liquid, such as a water glycol mix, through the primary circulation loop 8 of the heat exchanger 2.

Use of a heat exchanger with a liquid heater provides considerable added versatility to a temporary heating system. Conventionally such liquid heaters are directly connected to flexible conduits to circulate hot fluid through liquid coils in portable remote heating units. By providing a heat exchanger, the liquid heater is isolated from the heating circuit. Thus much higher pressures can be exerted on the heated liquid in the heating circuit, for example where the remote heating units are located several hundred feet above the liquid heater in a high rise building, without these pressures being exerted in the liquid heater. Thus the added costs of making a liquid heater that conforms to pressure vessel regulations are avoided, and the system can be used with a conventional liquid heater.

Figure 2:
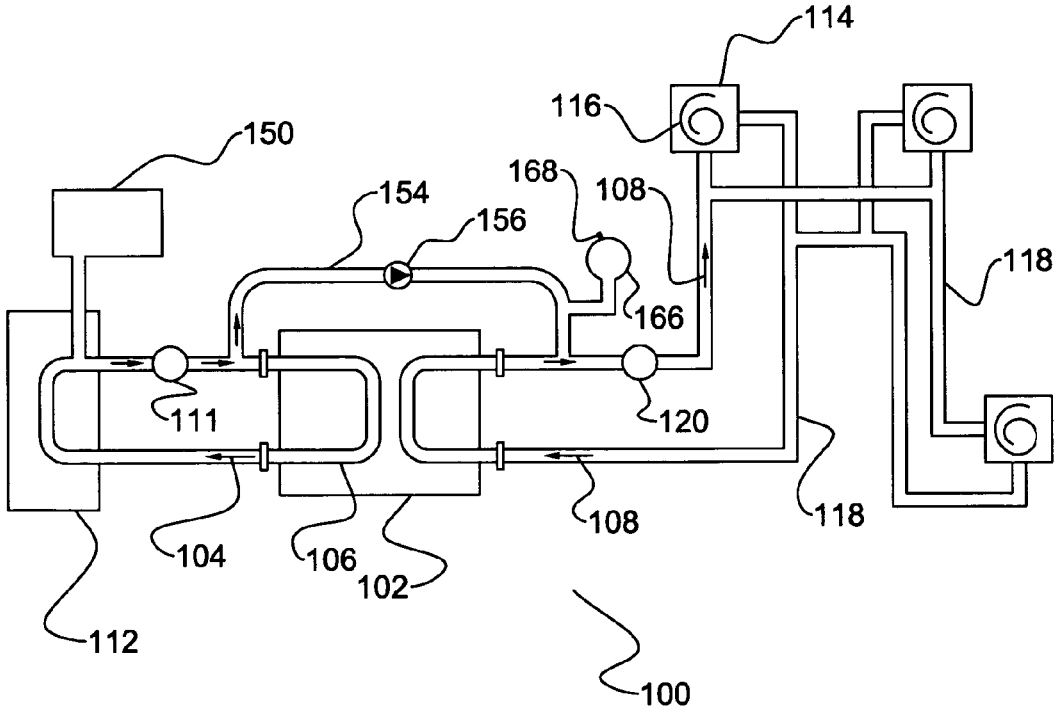
FIG. 2 is a schematic illustration of a temporary heating apparatus of the present invention where the hot fluid source is a liquid heater.

FIG. 2 schematically illustrates a temporary heating apparatus 100 of the present invention where the hot fluid source is provided by a liquid heater 112. The liquid heater 112 is operatively connected to the primary circulation loop 106 of the heat exchanger 102, and a primary pump 111 is operative to circulate hot liquid 104 from the liquid heater 112 through the primary circulation loop 106. A secondary pump 120 pumps heated liquid through the secondary circulation loop 110 of the heat exchanger 102 through flexible conduits 118 releasably connected to the secondary circulation loop 110 and to liquid coils 116 in remote heating units 114.

A primary liquid reservoir 150 is operatively connected to an intake of the primary pump 111. The primary liquid reservoir 150 is open to the atmosphere, and is located higher than the primary circulation loop and primary pump 111. Conveniently, a cross-feed conduit 154 is operatively connected to the output of the primary pump 111 and to the heating circuit, for example at the secondary circulation loop 110 of the heat exchanger 102 at the intake of the secondary pump 120. A cross-feed check valve 156 is operative to allow liquid to flow from the output of the primary pump 11 through the cross-feed conduit 154, and is operative to prevent liquid from flowing in an opposite direction through the cross-feed conduit 154 from the heating circuit to the output of the primary pump. When the heating circuit has been connected, and the primary pump 111 is operating to circulate hot liquid 104 through the primary circulation loop 106, hot liquid will flow through the cross-feed conduit 154 and into the heating circuit to fill the conduits 118, secondary circulation loop 110, and coils 16. This flow will continue until the pressure at the inlet of the secondary pump 120 becomes greater than the pressure at the outlet of the primary pump 11, at which point the cross-feed check valve 156 will close and prevent backflow to the primary circuit. Conventional liquid heaters typically include such a primary liquid reservoir, and same can be conveniently used in this manner to add liquid to the heating circuit without a risk of liquid flowing back from the secondary loop to the primary loop when the pumps are shut off. Since the heating circuit is effectively closed from the atmosphere, a conventional closed expansion tank 166 and properly sized pressure relief valve 168 are provided required.

Figure 3:
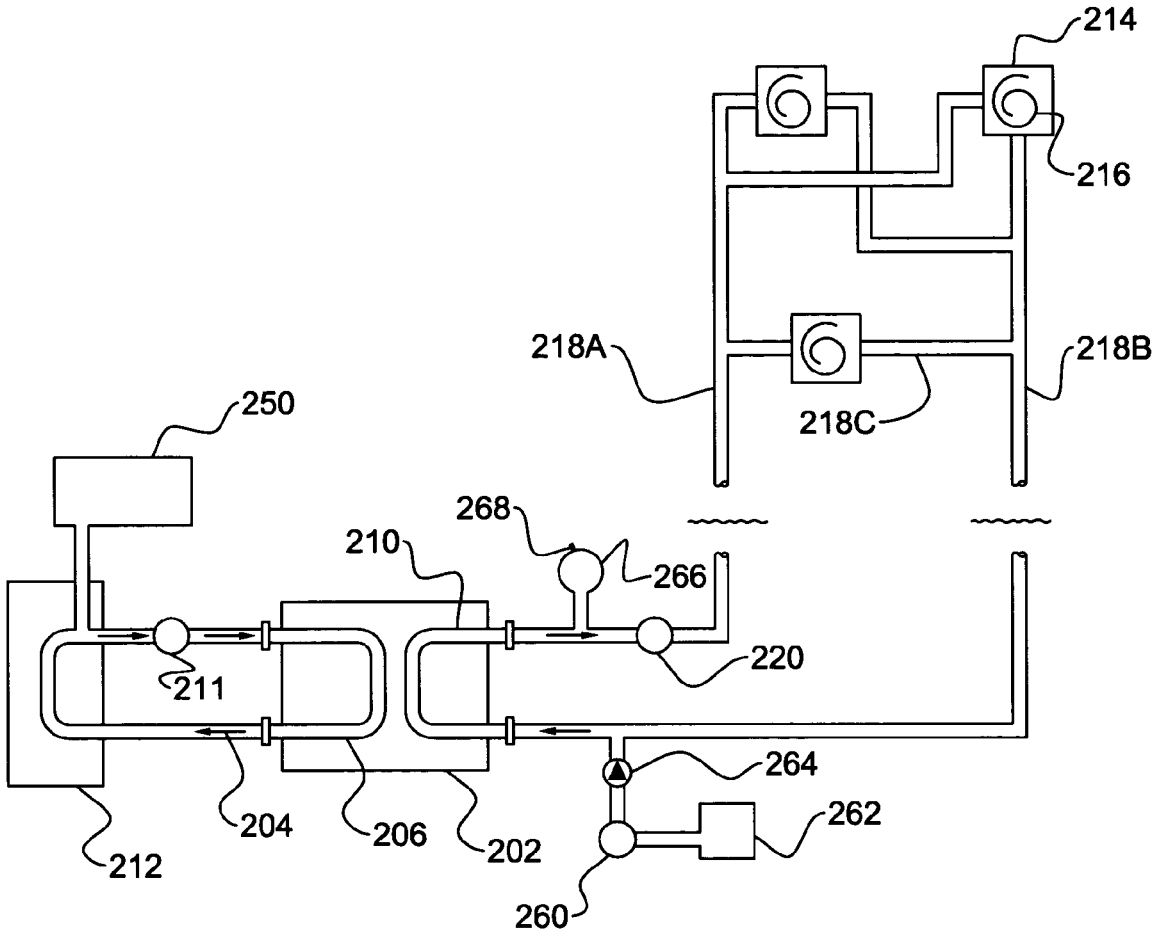
FIG. 3 is a schematic illustration of a temporary heating apparatus of the present invention where the hot fluid source is a liquid heater and where the remote heating units are located in upper floors of a tall building.

The apparatus 200 of FIG. 3 comprises a liquid heater 212 is operatively connected to the primary circulation loop 206 of the heat exchanger 202, and a primary pump 211 is operative to circulate hot liquid 204 from the liquid heater 212 through the primary circulation loop 206. A secondary pump 220 pumps heated liquid through the secondary circulation loop 210 of the heat exchanger 202 through flexible conduits 218 releasably connected to the secondary circulation loop 210 and to liquid coils 216 in remote heating units 214.

The embodiment of FIG. 3 illustrates the advantages of the use of a heat exchanger 202 where the remote heating units 214 are located at a much higher elevation than the liquid heater 212. Such an arrangement would be convenient for temporary heating of the upper floors of a tall building, where the fluid heater 212, illustrated as a liquid heater, but which could also be a steam heater, could conveniently be located on the ground or main floor, and the flexible conduits 218 connected to remote heating units 214 located on any of the upper floors where heat is required. The heated liquid 208 circulates upwards through an upward flexible conduit 218A to the remote heating units 214, and circulates downward from the remote heating units 214 through a downward flexible conduit 218B back to the secondary circulation loop 210 of the heat exchanger 202 to be heated again. Branch conduits 218C can be tapped off from the vertical upward conduit 218A and back in to the vertical downward conduit on any floor that requires heat. This would be done in a parallel piping arrangement by placing releasable tees or a manifold at any floor where heat is required.

The heating circuit is filled with heated liquid 208 by operating the secondary pump 220 at sufficient pressure to reach the remote heating units 214 at their elevated location. The pressure at the bottom of the heating circuit will be approximately equal to the pressure head of liquid in a tube extending from the heat exchanger 202 up to the remote heating units 214. Where the remote heating units are on the $70^{th}$ floor for example, the pressure in the secondary circulation loop 210 of the heat exchanger 202 will be about 300 psi. The pressure in the primary circulation loop 206 and the fluid heater 212 will, however, be unaffected.

Flexible conduits 218 can readily be made to withstand pressures of 300 psi or more, however it has been found that the down flexible conduit 218B containing heated liquid 208 that is moving downward tends to collapse. The pressure of the heated liquid 208 in the flexible conduit 218 at the top of the heating circuit is quite low and as the liquid begins to move downward, suction is created that draws the walls of the flexible conduit 218B inward and can block the flow of heated liquid 208 through the conduit.

While the reason for this collapse is not known with certainty, it is contemplated that the elasticity of the walls of the flexible conduit 218 allows the upward side 218A to stretch somewhat when the secondary pump 220 is started, due to the additional pressure exerted by the secondary pump. Stretching due to additional pressure can be present through the entire length of the conduit 218 as far as the last heating coil 216. If the circuit is closed, the return hose will collapse, starting at the top, where the liquid column pressure is lowest. Further, liquid in the downward conduit 218B is also "falling", and being accelerated by the force of gravity, which could create suction.

Reinforcing the flexible conduit 218B to reduce or prevent such collapse is costly, and makes the conduit 218 much more difficult to handle, store, and transport.

This problem of collapsing conduit walls can be addressed by placing an open liquid reservoir at the top of the heating circuit such that the highest location of the circulating heating liquid 208 is open to the atmosphere. Thus the downward portion of the heating circuit becomes simply a column of liquid open to the atmosphere at the top end thereof, and the weight of the liquid maintains pressure on the downward flexible conduit 218B.

The embodiment of FIG. 3 illustrates an alternative more convenient means to prevent collapse of the down flexible conduit 218B. An auxiliary reservoir 260 is provided, and a booster pump 262 has an intake connected to draw from the auxiliary reservoir 260 and an output operatively connected to the down flexible conduit 218 such that liquid in the auxiliary reservoir 260 can be pumped into the down flexible conduit 218. A check valve 264 prevent liquid from flowing out of the downward flexible conduit 218B back into the auxiliary reservoir 260. Since the heating circuit is effectively closed from the atmosphere, a conventional closed expansion tank 266 and properly sized pressure relief valve 268 are provided. The injector pump 260, auxiliary reservoir 262, check valve 264, expansion tank 266, and pressure relief valve 268 will be integrated with the heat exchanger 202 into a conveniently portable unit.

During heating operations flow through the auxiliary pump 262 will be negligible, however the pressure at the output of the auxiliary pump 262 can be made sufficient to maintain pressure in the downward portion of the down flexible conduit 218B, and prevent collapse of the walls. Liquid from the auxiliary reservoir 260 will also enter the heating circuit to make up any liquid lost by leaks. Depending on the pump used, liquid from the auxiliary reservoir 260 could also serve to initially fill the heating circuit with liquid as well.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A temporary heating apparatus comprising:

a portable heat exchanger operative to transfer heat from a hot fluid circulating in a primary circulation loop thereof to a heated liquid circulating in a secondary circulation loop thereof;

wherein the heat exchanger is adapted for connection to a hot fluid source such that hot fluid from the hot fluid source circulates through the primary circulation loop;

at least one portable remote heating unit comprising a fluid coil releasably connected by flexible conduits to the secondary circulation loop; and a secondary pump operatively connected to the flexible conduits and to the secondary circulation loop of the heat exchanger and operative to pump heated liquid through the secondary circulation loop, flexible conduits, and the fluid coil of the at least one remote heating unit.

2. The apparatus of claim 1 wherein the hot fluid comprises steam.

3. The apparatus of claim 2 wherein the hot fluid source is one of a steam generation utility and a steam boiler.

4. The apparatus of claim 1 further comprising a secondary liquid reservoir operatively connected to an intake of the secondary pump.

5. The apparatus of claim 1 wherein the hot fluid comprises a hot liquid.

6. The apparatus of claim 5 further comprising a liquid heater operatively connected to the primary circulation loop of the heat exchanger, and a primary pump operative to circulate hot liquid from the liquid heater through the primary circulation loop.

7. The apparatus of claim 6 comprising a primary liquid reservoir operatively connected to an intake of the primary pump.

8. The apparatus of claim 7 further comprising a cross-feed conduit operatively connected to an output of the primary pump and to the flexible conduits, and a cross-feed check valve operative to allow liquid to flow from the output of the primary pump through the cross-feed conduit, and operative to prevent liquid from flowing in an opposite direction through the cross-feed conduit from the flexible conduits to output of the primary pump.

9. The apparatus of claim 8 wherein the cross-feed conduit is operatively connected to the flexible conduits by connection to an intake of the secondary pump.

10. The apparatus of claim 1 wherein the hot liquid circulates upwards through an upward flexible conduit to the at least one remote heating unit, and circulates downward from the at least one remote heating unit through a downward flexible conduit, and further comprising an auxiliary reservoir and a booster pump having an intake connected to draw from the auxiliary reservoir and having an output operatively connected to the downward flexible conduit such that liquid in the auxiliary reservoir can be pumped into the downward flexible conduit, and a check valve to prevent liquid from flowing out of the downward flexible conduit back into the auxiliary reservoir.

11. A temporary heating system comprising:

a portable heat exchanger operative to transfer heat from a hot liquid circulating in a primary circulation loop thereof to a heated liquid circulating in a secondary circulation loop thereof;

a liquid heater and a primary pump operatively connected to the liquid heater and operative to circulate hot liquid from the liquid heater through the primary circulation loop;

a plurality of portable remote heating units, each remote heating unit comprising a fluid coil releasably connected by flexible conduits to the secondary circulation loop; and a secondary pump operatively connected to the flexible conduits and to the secondary circulation loop of the heat exchanger and operative to pump heated liquid through the secondary circulation loop, flexible conduits, and the fluid coils of the remote heating units.

12. The apparatus of claim 11 comprising a liquid reservoir operatively connected to an intake of the primary pump.

13. The apparatus of claim 12 further comprising a cross-feed conduit operatively connected to an output of the primary pump and to the flexible conduits, and a cross-feed check valve operative to allow liquid to flow from the output of the primary pump through the cross-feed conduit, and operative to prevent liquid from flowing in an opposite direction through the cross-feed conduit from the flexible conduits to output of the primary pump.

14. The apparatus of claim 13 wherein the cross-feed conduit is operatively connected to the flexible conduits by connection to an intake of the secondary pump.

15. The apparatus of claim 11 wherein the heated liquid circulates upwards through an upward flexible conduit to at least one remote heating unit, and circulates downward from the at least one remote heating unit through a downward flexible conduit, and further comprising an auxiliary reservoir and a booster pump having an intake connected to draw from the auxiliary reservoir and having an output operatively connected to the downward flexible conduit such that liquid in the auxiliary reservoir can be pumped into the downward flexible conduit, and a check valve to prevent liquid from flowing out of the downward flexible conduit back into the auxiliary reservoir.

* * * * *